US009406311B2

(12) United States Patent
Ito et al.

(10) Patent No.: US 9,406,311 B2
(45) Date of Patent: Aug. 2, 2016

(54) ENCODING METHOD, ENCODING APPARATUS, AND COMPUTER READABLE RECORDING MEDIUM

(75) Inventors: Shusaku Ito, Fukuoka (JP); Yoshiteru Tsuchinaga, Fukuoka (JP); Katsumori Hagiwara, Kawasaki (JP); Sosaku Moriki, Fukuoka (JP)

(73) Assignee: FUJITSU LIMITED, Kawasaki (JP)

( * ) Notice: Subject to any disclaimer, the term of this patent is extended or adjusted under 35 U.S.C. 154(b) by 404 days.

(21) Appl. No.: 13/592,548

(22) Filed: Aug. 23, 2012

(65) Prior Publication Data

US 2013/0054254 A1 Feb. 28, 2013

(30) Foreign Application Priority Data

Aug. 30, 2011 (JP) ..... 2011-187570

(51) Int. Cl.

| | |
|---|---|
| ***G10L 19/00*** | (2013.01) |
| ***G10L 21/00*** | (2013.01) |
| ***G10L 21/038*** | (2013.01) |
| *G10L 19/025* | (2013.01) |

(52) U.S. Cl.

CPC ..... *G10L 21/038* (2013.01); *G10L 19/025* (2013.01)

(58) Field of Classification Search

None

See application file for complete search history.

(56) References Cited

U.S. PATENT DOCUMENTS

| | | | | |
|---|---|---|---|---|
| 5,001,758 | A * | 3/1991 | Galand | G10L 19/06 704/207 |
| 6,266,644 | B1 * | 7/2001 | Levine | G10L 19/20 704/200.1 |
| 6,978,236 | B1 * | 12/2005 | Liljeryd | G10L 19/0208 704/200 |
| 8,000,968 | B1 * | 8/2011 | Liu | G10L 19/24 370/477 |
| 8,041,578 | B2 * | 10/2011 | Schnell | G10L 19/025 704/201 |

(Continued)

FOREIGN PATENT DOCUMENTS

| | | |
|---|---|---|
| JP | 2008-129541 | 6/2008 |
| JP | 2010-507113 | 3/2010 |
| WO | 2008/046505 A1 | 4/2008 |

OTHER PUBLICATIONS

"Audio Coding Algorithm for One-Segment Broadcasting", Fujitsu. 58, 2, pp. 162-167, Mar. 2007.

(Continued)

*Primary Examiner* — Richemond Dorvil
*Assistant Examiner* — Thuykhanh Le
(74) *Attorney, Agent, or Firm* — Staas & Halsey LLP

(57) ABSTRACT

An encoding method executed by a computer, the method includes converting by the computer information about a transient included in a low-frequency component of an audio signal into information about a transient included in a high-frequency component of the audio signal, detecting, by the computer the transient of the high-frequency component of the audio signal based on the high-frequency component of the audio signal and on the information about the transient of the high-frequency component obtained by the converting; and encoding, by the computer the high-frequency component of the audio signal based on the transient detected by the detecting.

18 Claims, 24 Drawing Sheets

(56) References Cited

U.S. PATENT DOCUMENTS 8,126,721 B2 * 2/2012 Schnell ..... G10L 21/038 704/203
8,489,391 B2 * 7/2013 Kurniawati ..... G10L 19/24 704/206
2008/0147415 A1 * 6/2008 Schnell ..... G10L 21/038 704/501
2008/0221905 A1 * 9/2008 Schnell ..... G10L 21/038 704/500
2008/0288262 A1 * 11/2008 Makiuchi ..... G10L 19/24 704/500
2009/0070120 A1 * 3/2009 Suzuki ..... G10L 19/0204 704/500
2009/0271204 A1 * 10/2009 Tammi ..... G10L 19/0208 704/500
2010/0114583 A1 * 5/2010 Lee ..... G10L 19/025 704/500
2011/0046965 A1 * 2/2011 Taleb ..... G10L 19/025 704/501
2011/0099018 A1 * 4/2011 Neuendorf ..... G10L 21/038 704/500
2011/0112670 A1 * 5/2011 Disch ..... G10L 21/04 700/94
2011/0166865 A1 * 7/2011 Chakravarthy ..... G10L 19/002 704/500
2011/0194598 A1 * 8/2011 Miao ..... G10L 19/002 375/240
2011/0246205 A1 * 10/2011 Lin ..... G10L 21/04 704/500
2011/0251846 A1 * 10/2011 Liu ..... G10L 19/025 704/500
2011/0257980 A1 * 10/2011 Gao ..... G10L 21/038 704/500
2012/0022676 A1 * 1/2012 Ishikawa ..... G10L 21/04 700/94
2012/0035936 A1 * 2/2012 Kurniawati ..... G10L 19/24 704/500
2012/0065983 A1 * 3/2012 Ekstrand ..... G10L 21/038 704/500
2012/0215546 A1 * 8/2012 Biswas ..... G10H 1/40 704/500
2012/0323582 A1 * 12/2012 Peng ..... G10L 19/025 704/500

OTHER PUBLICATIONS

Japanese Office Action issued Jan. 13, 2015 in corresponding Japanese Patent Application No. 2011-187570.

* cited by examiner

FIG. 4

| PRESENCE/ABSENCE OF TRANSIENT | PRESENCE |
|---|---|
| FRAME NUMBER | n−2 |
| SUBFRAME NUMBER | 2 |

FIG. 6

| PRESENCE/ABSENCE OF TRANSIENT | PRESENCE |
|---|---|
| FRAME NUMBER | n |

FIG. 12

| PRESENCE/ABSENCE OF TRANSIENT | PRESENCE |
|---|---|
| TRANSIENT POSITION | GROUP 2, #4 |
| FRAME NUMBER | n−2 |

FIG. 14

| PRESENCE/ABSENCE OF TRANSIENT | PRESENCE |
|---|---|
| FRAME NUMBER | n |
| SUBFRAME NUMBER | #9 |

FIG. 18

| PRESENCE/ABSENCE OF TRANSIENT | PRESENCE |
|---|---|
| TRANSIENT POSITION | #1 |
| FRAME NUMBER | n−2 |

FIG. 20

| PRESENCE/ABSENCE OF TRANSIENT | PRESENCE |
|---|---|
| FRAME NUMBER | n |
| SUBFRAME NUMBER | #8 |

ENCODING METHOD, ENCODING APPARATUS, AND COMPUTER READABLE RECORDING MEDIUM

CROSS-REFERENCE TO RELATED APPLICATION

This application is based upon and claims the benefit of priority of the prior Japanese Patent Application No. 2011-187570, filed on Aug. 30, 2011, the entire contents of which are incorporated herein by reference.

FIELD

The embodiments discussed herein are related to an encoding method and the like.

BACKGROUND

One of the coding schemes for an audio signal is High Efficiency-Advanced Audio Coding (HE-AAC). In HE-AAC, low-frequency components of an audio signal are encoded with AAC encoding, and high-frequency components are encoded with spectral band replication (SBR) encoding, thereby improving the coding efficiency.

An exemplary encoding apparatus of the related art will be described which encodes an audio signal with HE-AAC. FIG. 23 is a diagram illustrating a configuration of an encoding apparatus 50 of the related art. As illustrated in FIG. 23, the encoding apparatus 50 includes a downsampler 10, an AAC encoder 20, an SBR encoder 30, and a multiplexer 40.

The downsampler 10 is a processor that performs downsampling on an audio signal. The downsampler 10 outputs the audio signal having a low-frequency component obtained through the downsampling, to the ACC encoder 20.

The ACC encoder 20 is a processor that applies ACC to the audio signal having the low-frequency component so as to encode the audio signal having the low-frequency component. The ACC encoder 20 outputs the encoded audio signal having the low-frequency component to the multiplexer 40.

The SBR encoder 30 is a processor that encodes the high-frequency component of the audio signal. The SBR encoder 30 outputs the encoded high-frequency component of the audio signal to the multiplexer 40. The SBR encoder 30 controls quantization of the audio signal in such a manner that the time resolution is set to high when the audio signal has a transient, or that the frequency resolution is set to high when the audio signal is stationary. The state in which an audio signal has a transient means that, for example, the audio signal includes an abrupt amplitude change.

The multiplexer 40 is a processor that multiplexes the encoded audio signal having the low-frequency component and the encoded audio signal having the high-frequency component and that outputs the multiplexed audio signal to an external apparatus.

Now, an example of the SBR encoder 30 illustrated in FIG. 23 will be described. FIG. 24 is a diagram illustrating a configuration of the SBR encoder 30. As illustrated in FIG. 24, the SBR encoder 30 includes an analysis filter bank 31, a transient detector 32, a grid information generator 33, a spectrum estimator 34, an additional information determiner 35, a quantizer 36, and a multiplexer 37.

The analysis filter bank 31 is a processor that transforms an audio signal into a time-frequency spectrum. The analysis filter bank 31 outputs the audio signal subjected to a time-frequency-spectrum transformation to the transient detector 32, the spectrum estimator 34, and the additional information determiner 35.

The transient detector 32 is a processor that analyzes the audio signal and that detects a state in which the audio signal has a transient. The transient detector 32 outputs the detection result to the grid information generator 33.

FIG. 25 is a diagram for explaining a process performed by the transient detector 32. As illustrated in FIG. 25, the transient detector 32 sets a detection range 60, and divides the detection range 60 into 16 sections. The detection range 60 is set so as to start in a frame 1A and end in a frame 2A. The frame 1A is a target frame to be subjected to SBR encoding, and the frame 2A is subsequent to the frame 1A. The transient detector 32 analyzes the detection range 60 and detects a section in which a signal having an abrupt amplitude change is included. Then, the transient detector 32 outputs the presence/absence of a transient and the position of the transient signal to the grid information generator 33. The transient detector 32 determines presence/absence of a transient for each of the frames.

The grid information generator 33 is a processor that controls the quantizer 36 so that the time resolution is set to high when the audio signal has a transient, and the frequency resolution is set to high when the audio signal is stationary.

The spectrum estimator 34 is a processor that outputs, to the quantizer 36, supplementary information used for replicating the high-frequency component from the low-frequency component. The additional information determiner 35 is a processor that outputs, to the quantizer 36 and the multiplexer 37, additional information representing the high-frequency component of the audio signal.

The quantizer 36 is a processor that encodes the high-frequency component with the time resolution and the frequency resolution which are determined under the control of the grid information generator 33. The quantizer 36 outputs the encoded high-frequency component of the audio signal to the multiplexer 37.

The multiplexer 37 is a processor that multiplexes the encoded audio signal having the high-frequency component, which is output from the quantizer 36, and the additional information, and outputs the multiplexed information.

However, in the related art described above, there is a problem in that the implementation scale and the processing load are large.

As illustrated in FIG. 24, since the transient detector 32 is implemented to detect a transient in an audio signal, the SBR encoder 30 has a large implementation scale. In addition, as illustrated in FIG. 25, since the detection of a transient is performed for each of frames, the transient detector 32 has a heavy processing load.

Regarding the related art, see Japanese Laid-open Patent Publication No. 2008-129541.

In addition, regarding the related art, see Suzuki, Masanao, Ota, Yasuji, and Ito, Takashi, "Wansegu Housou Muke Audio Fugouka Gijutsu (Audio Coding Algorithm for One-Segment Broadcasting)," *FUJITSU*.58, 2, pp. 162-167, March 2007.

SUMMARY

According to an aspect of the embodiments, an encoding method executed by a computer, the method includes converting the computer information about a transient included in a low-frequency component of an audio signal into information about a transient included in a high-frequency component of the audio signal; detecting, by the computer the transient of the high-frequency component of the audio signal based on the high-frequency component of the audio signal and on the information about the transient of the high-frequency component obtained by the converting; and encoding, by the computer the high-frequency component of the audio signal based on the transient detected by the detecting.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4 is a diagram illustrating an exemplary data structure of information about a transient of a low-frequency component according to the first embodiment;

FIG. 6 is a diagram illustrating an exemplary data structure of information about a transient of a high-frequency component according to the first embodiment;

FIG. 12 is a diagram illustrating an exemplary data structure of grouping information;

FIG. 14 is a diagram illustrating an exemplary data structure of information about a transient of a high-frequency component according to the second embodiment;

FIG. 18 is a diagram illustrating an exemplary data structure of information about a transient of a low-frequency component according to the third embodiment;

FIG. 20 is a diagram illustrating an exemplary data structure of information about a transient of a high-frequency component according to the third embodiment;

DESCRIPTION OF EMBODIMENTS

Embodiments of an encoding method, an encoding apparatus, and an encoding program which are disclosed herein will be described in detail below based on the drawings. These embodiments are not limited to the disclosure set forth herein.

First Embodiment

Figure 1:
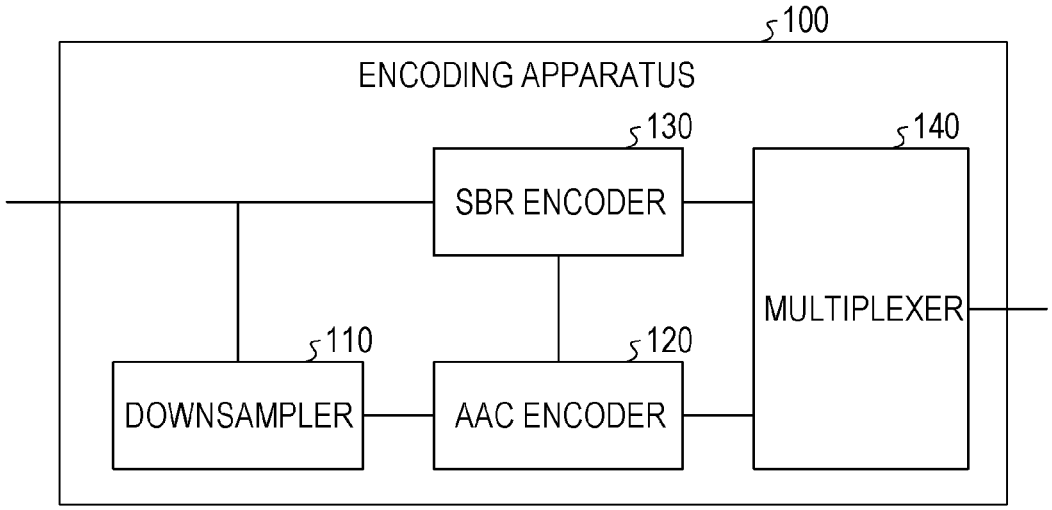
FIG. 1 is a diagram illustrating a configuration of an encoding apparatus according a first embodiment.

FIG. 1 is a diagram illustrating a configuration of an encoding apparatus according a first embodiment. An encoding apparatus 100 encodes the low-frequency component of an audio signal in accordance with AAC encoding, and encodes the high-frequency component in accordance with SBR encoding. As illustrated in FIG. 1, the encoding apparatus 100 includes a downsampler 110, an AAC encoder 120, an SBR encoder 130, and a multiplexer 140.

The downsampler 110 is a processor that performs downsampling on an audio signal. The downsampler 110 outputs the audio signal having a low-frequency component obtained through the downsampling, to the AAC encoder 120.

The AAC encoder 120 is a processor that applies AAC to the audio signal having the low-frequency component so as to encode the audio signal having the low-frequency component. The AAC encoder 120 outputs the encoded audio signal having the low-frequency component to the multiplexer 140.

The AAC encoder 120 determines whether or not the audio signal having the low-frequency component has a transient based on the audio signal. The AAC encoder 120 outputs, to the SBR encoder 130, the determination result as to whether or not the audio signal has a transient. In the following description, the determination result as to whether or not the audio signal has a transient is referred to as transient information of the low-frequency component.

The SBR encoder 130 is a processor that encodes the high-frequency component of the audio signal. The SBR encoder 130 outputs the encoded high-frequency component of the audio signal to the multiplexer 140. The SBR encoder 130 controls quantization so that the time resolution is set to high when the audio signal has a transient, and the frequency resolution is set to high when the audio signal is stationary.

The SBR encoder 130 converts the transient information of the low-frequency component obtained from the AAC encoder 120 into transient information of the high-frequency component, and determines whether or not the audio signal has a transient based on the transient information of the high-frequency component.

Figure 2:
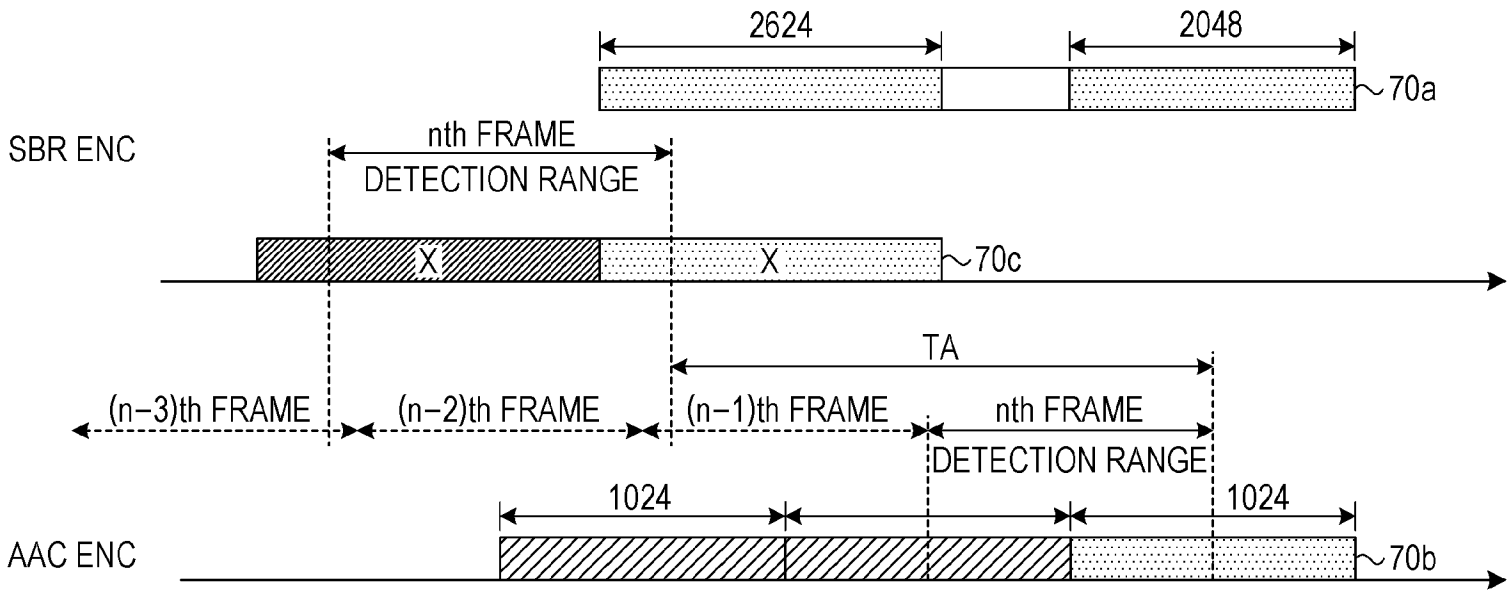
FIG. 2 is a diagram illustrating timing at which an audio signal is processed by encoders.

FIG. 2 is a diagram illustrating timing at which an audio signal is processed by the encoders. In FIG. 2, the horizontal axis represents a time axis. A signal 70*a* is an audio signal received by the encoding apparatus 100. A signal 70*b* is an audio signal obtained through downsampling. A signal 70*c* is an audio signal obtained through frequency conversion performed by the SBR encoder 130 by using, for example, a quadrature mirror filter (QMF). The AAC encoder 120 performs AAC encoding on the signal 70*b*, and the SBR encoder 130 performs SBR encoding on the signal 70*c*.

The phase or the like of the audio signal to be analyzed by the AAC encoder 120 is different from that of the audio signal to be analyzed by the SBR encoder 130. In the example illustrated in FIG. 2, the phase in which the AAC encoder 120 processes the nth frame is different by TA from the phase in which the SBR encoder 130 processes the nth frame. The nth frame corresponds to a frame which is located as the nth frame from the first frame.

Because of this, the SBR encoder 130 adjusts the phase in the transient information of the low-frequency component, thereby converting the transient information of the low-frequency component into that of the high-frequency component. The SBR encoder 130 sets the timing obtained by shifting by TA the timing at which a transient is detected for the low-frequency component, as the timing at which a transient occurs in the high-frequency component. The detailed description about the SBR encoder 130 will be made below.

The multiplexer 140 is a processor that multiplexes the encoded audio signal having the low-frequency component and the encoded audio signal having the high-frequency component and that outputs the multiplexed audio signal to an external apparatus.

Figure 3:
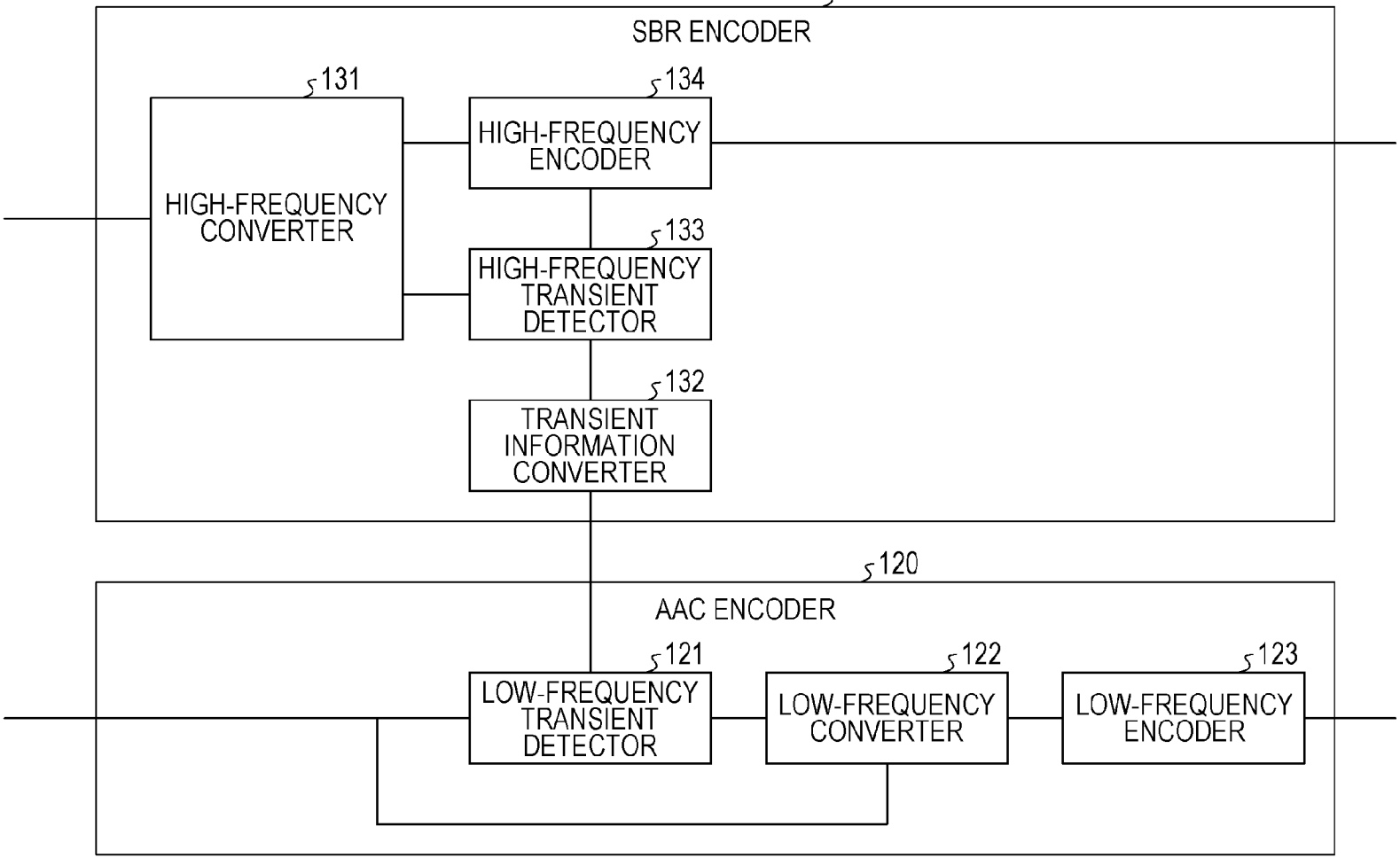
FIG. 3 is a functional block diagram illustrating a configuration of an AAC encoder and an SBR encoder according to the first embodiment.

Now, an exemplary configuration of the AAC encoder 120 and the SBR encoder 130 which are illustrated in FIG. 1 will be described. FIG. 3 is a functional block diagram illustrating a configuration of the AAC encoder 120 and the SBR encoder 130 according to the first embodiment.

As illustrated in FIG. 3, the AAC encoder 120 includes a low-frequency transient detector 121, a low-frequency converter 122, and a low-frequency encoder 123. The SBR encoder 130 includes a high-frequency converter 131, a transient information converter 132, a high-frequency transient detector 133, and a high-frequency encoder 134.

The low-frequency transient detector 121 sequentially obtains the frames of the audio signal obtained through the downsampling, and divides each of the frames into eight subframes. The low-frequency transient detector 121 analyzes each of the subframes and detects a subframe including a transient. For example, the low-frequency transient detector 121 detects a subframe having an abrupt amplitude change, as a subframe including a transient. The low-frequency transient detector 121 outputs the detection result to the transient information converter 132 as transient information of the low-frequency component. In addition, the low-frequency transient detector 121 outputs the detection result to the low-frequency converter 122.

FIG. 4 is a diagram illustrating an exemplary data structure of transient information of the low-frequency component according to the first embodiment. As illustrated in FIG. 4, the transient information of the low-frequency component includes data on the presence/absence of a transient, the frame number, and the subframe number. For example, when the second subframe in the (n−2)th frame includes a transient, the data on the presence/absence of a transient is "presence", the data on the frame number is "n−2", and the data on the subframe number is "2".

The low-frequency converter 122 is a processor that performs frequency conversion on the audio signal in accordance with the detection result obtained by the low-frequency transient detector 121. The low-frequency converter 122 outputs the audio signal obtained through the frequency conversion, to the low-frequency encoder 123.

Now, the SBR encoder 130 will be described. The high-frequency converter 131 is a processor that performs frequency conversion on an audio signal. The high-frequency converter 131 outputs the audio signal obtained through the frequency conversion, to the high-frequency transient detector 133 and the high-frequency encoder 134.

Figure 5:
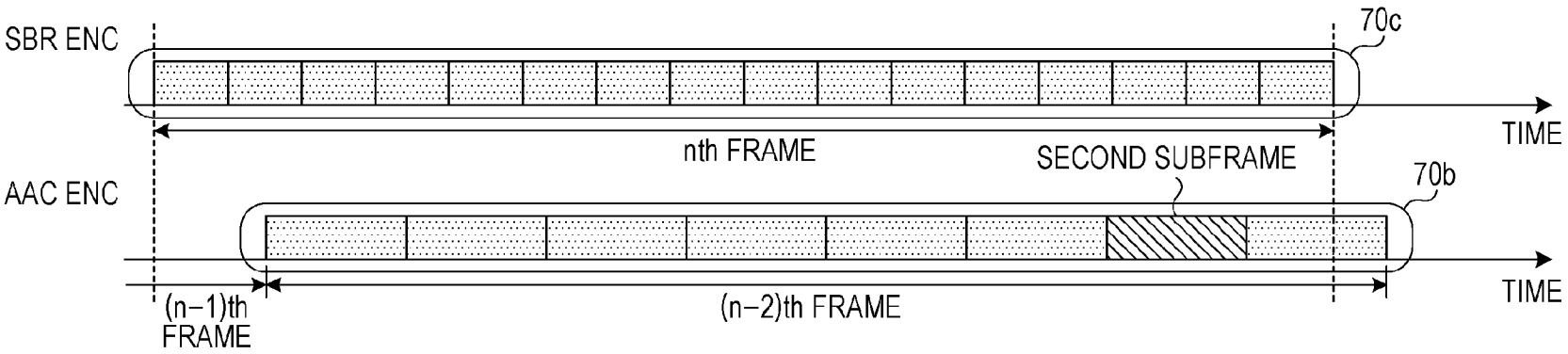
FIG. 5 is a diagram for explaining a process performed by a transient information converter according to the first embodiment.

The transient information converter 132 is a processor that converts the transient information of the low-frequency component into the transient information of the high-frequency component. FIG. 5 is a diagram for explaining a process performed by the transient information converter 132 according to the first embodiment. The horizontal axis in FIG. 5 corresponds to the time axis. For example, assume that the transient information of the low-frequency component indicates that the second subframe in the (n−2)th frame of the signal 70*b* includes a transient.

The transient information converter 132 determines which frame in the signal 70*c* corresponds to the time point obtained by adding a certain time period to the time point of the second subframe in the (n−2)th frame of the signal 70*b*. In the example illustrated in FIG. 5, the time point obtained by adding a certain time period to the time point of the second subframe in the (n−2)th frame of the signal 70*b* corresponds to the nth frame of the signal 70*c*. That is, it is found that the nth frame of the signal 70*c* includes a subframe including a transient.

The transient information converter 132 generates transient information of the high-frequency component based on the determination result. FIG. 6 is a diagram illustrating an exemplary data structure of the transient information of the high-frequency component according to the first embodiment. As illustrated in FIG. 6, the transient information of the high-frequency component includes data on the presence/absence of a transient and the frame number. For example, as described in FIG. 5, when the nth frame of the signal 70*c* includes a transient, the data on the presence/absence of a transient is "presence", and the data on the frame number is "n". The transient information converter 132 outputs the transient information of the high-frequency component to the high-frequency transient detector 133.

The high-frequency transient detector 133 is a processor that narrows down a frame to be subjected to detection of the presence/absence of a transient, based on the transient information of the high-frequency component, and that detects a subframe including a transient from the narrowed-down frame. For example, the case where the high-frequency transient detector 133 obtains the transient information of the high-frequency component as illustrated in FIG. 6 will be described.

For example, when the high-frequency transient detector 133 obtains the transient information of the high-frequency component as illustrated in FIG. 6, the high-frequency transient detector 133 divides the nth frame into 16 sections so as to generate subframes. Then, the high-frequency transient detector 133 analyzes the subframes and detects a subframe including a transient. For example, the high-frequency transient detector 133 detects a subframe having an abrupt amplitude change as the subframe including a transient.

The high-frequency transient detector 133 outputs the fame number and the subframe number at which a transient is included, to the high-frequency encoder 134.

The high-frequency encoder 134 is a processor that encodes the high-frequency component of the audio signal based on the detection result obtained by the high-frequency transient detector 133. The high-frequency encoder 134 encodes a frame including no transients with a high frequency resolution. For example, a frequency resolution which is equal to or more than a certain resolution is used.

In contrast, the high-frequency encoder 134 encodes the subframes in the frame including a transient with a high time resolution. For example, a time resolution which is equal to or more than a certain resolution is used. The high-frequency encoder 134 may encode a subframe including no transients with a high frequency resolution. The high-frequency encoder 134 outputs the encoded audio signal to the multiplexer 140.

Figure 7:
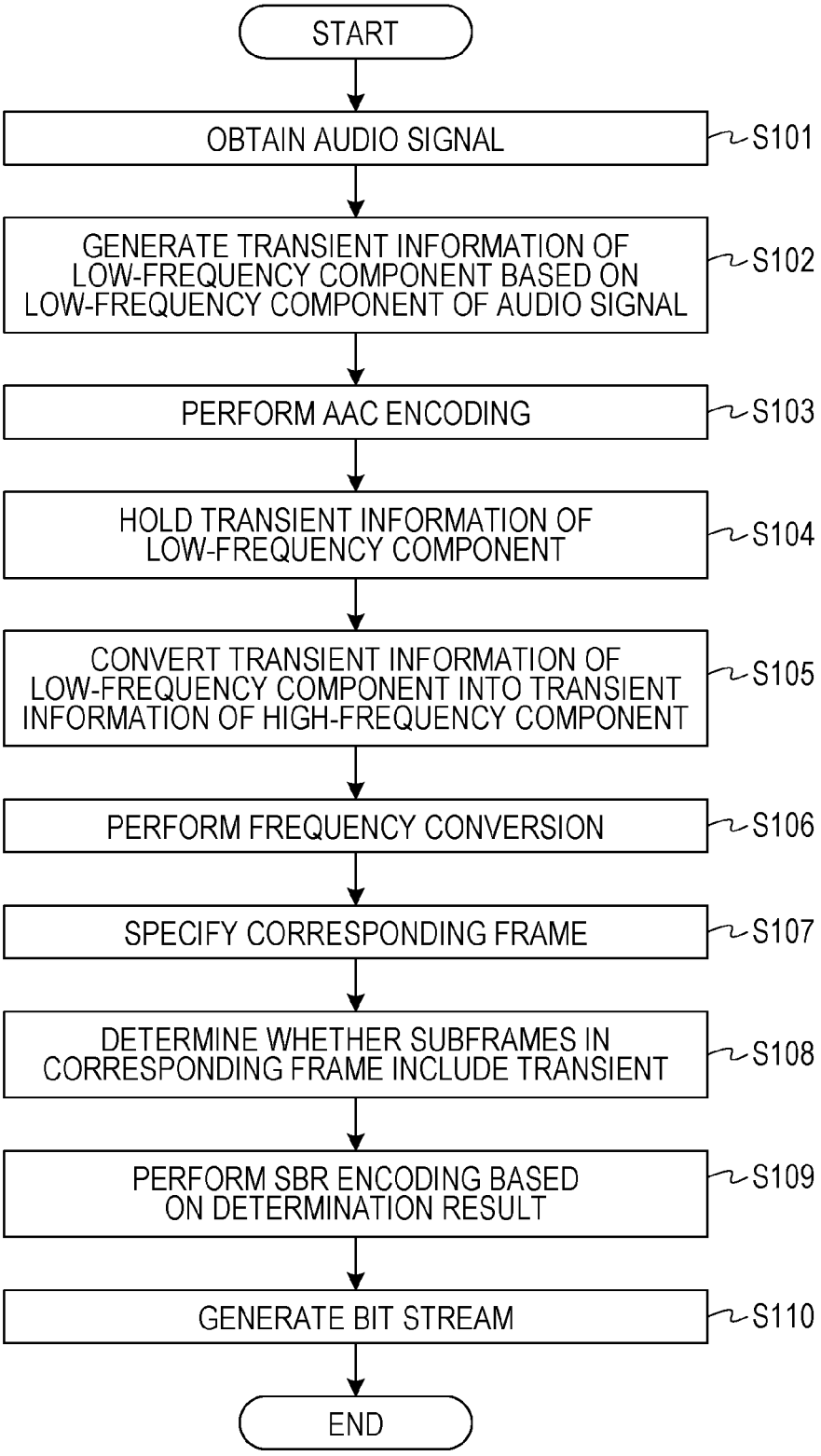
FIG. 7 is a flowchart of a procedure performed by the encoding apparatus according to the first embodiment.

Now, a procedure performed by the encoding apparatus 100 will be described. FIG. 7 is a flowchart of the procedure performed by the encoding apparatus 100 according to the first embodiment. The process illustrated in FIG. 7 is executed when, for example, an audio signal is obtained. As illustrated in FIG. 7, the encoding apparatus 100 obtains an audio signal in operation S101, and generates transient information of the low-frequency component based on the low-frequency component of the audio signal in operation S102. The encoding apparatus 100 performs AAC encoding in operation S103.

The encoding apparatus 100 holds the transient information of the low-frequency component of the audio signal in operation S104, and converts the transient information of the low-frequency component into transient information of the high-frequency component in operation S105. The encoding apparatus 100 performs frequency conversion in operation S106, and specifies a corresponding frame in operation S107. In operation S107, the corresponding frame is a frame specified from the transient information of the high-frequency component.

The encoding apparatus 100 determines whether the subframes included in the corresponding frame include a transient in operation S108. The encoding apparatus 100 performs SBR encoding based on the determination result in operation S109, and generates a bit stream in operation S110.

Now, an effect of the encoding apparatus 100 according to the first embodiment will be described. The encoding apparatus 100 converts the transient information of the low-frequency component into the transient information of the high-frequency component, and estimates a frame including a transient, in the audio signal having the high-frequency component. Thus, the SBR encoder 130 does not necessarily detect the presence/absence of a transient for all of the frames of an audio signal having a high-frequency component, resulting in reduction in the processing load.

Second Embodiment

Figure 8:
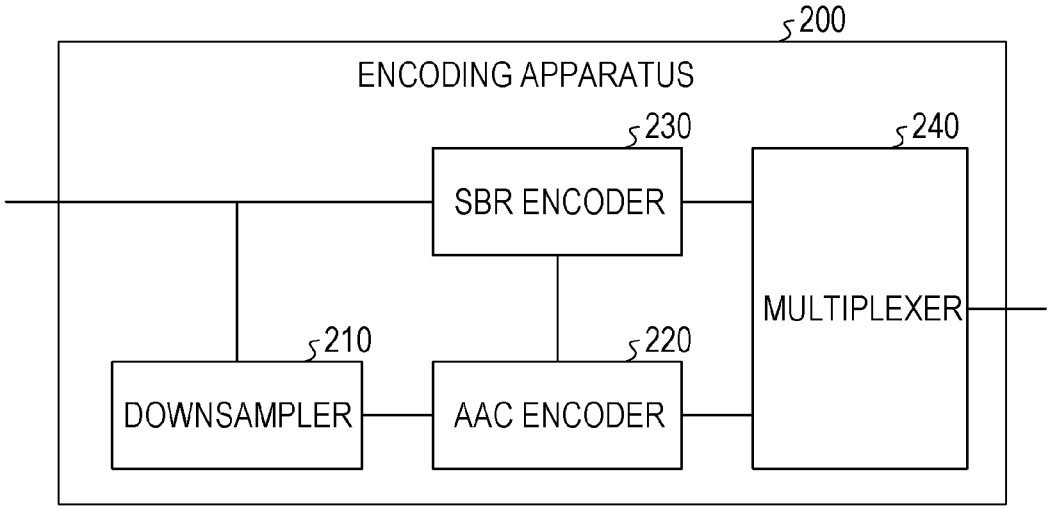
FIG. 8 is a diagram illustrating a configuration of an encoding apparatus according to a second embodiment.

Now, an encoding apparatus according to a second embodiment will be described. FIG. 8 is a diagram illustrating a configuration of the encoding apparatus according to the second embodiment. As illustrated in FIG. 8, an encoding apparatus 200 includes a downsampler 210, an AAC encoder 220, an SBR encoder 230, and a multiplexer 240.

The downsampler 210 is a processor that performs downsampling on an audio signal. The downsampler 210 outputs the audio signal having a low-frequency component obtained through the downsampling, to the AAC encoder 220.

The AAC encoder 220 is a processor that applies AAC to the audio signal having the low-frequency component so as to encode the audio signal having the low-frequency component. The AAC encoder 220 outputs the encoded audio signal having the low-frequency component to the multiplexer 240.

The AAC encoder 220 divides the audio signal having the low-frequency component into multiple subframes, and analyzes whether each of the subframes has a transient. The AAC encoder 220 separates the subframes into an arbitrary number of groups in accordance with the position of the transient, and outputs the determination result to the SBR encoder 230. In the description below, the determination result as to whether or not each group has a transient is referred to as grouping information.

The SBR encoder 230 is a processor that encodes the high-frequency component of an audio signal. The SBR encoder 230 outputs the encoded high-frequency component of the audio signal to the multiplexer 240. The SBR encoder 230 controls quantization so that the time resolution is set to high when the audio signal has a transient, and the frequency resolution is set to high when the audio signal is stationary.

The SBR encoder 230 converts the grouping information obtained from the AAC encoder 220 into transient information of the high-frequency component, and determines whether or not the audio signal has a transient based on the transient information of the high-frequency component. A process in which the SBR encoder 230 converts the grouping information into the transient information of the high-frequency component will be described below.

The multiplexer 240 is a processor that multiplexes the encoded audio signal having the low-frequency component and the encoded audio signal having the high-frequency component and that outputs the multiplexed audio signal to an external apparatus.

Figure 9:
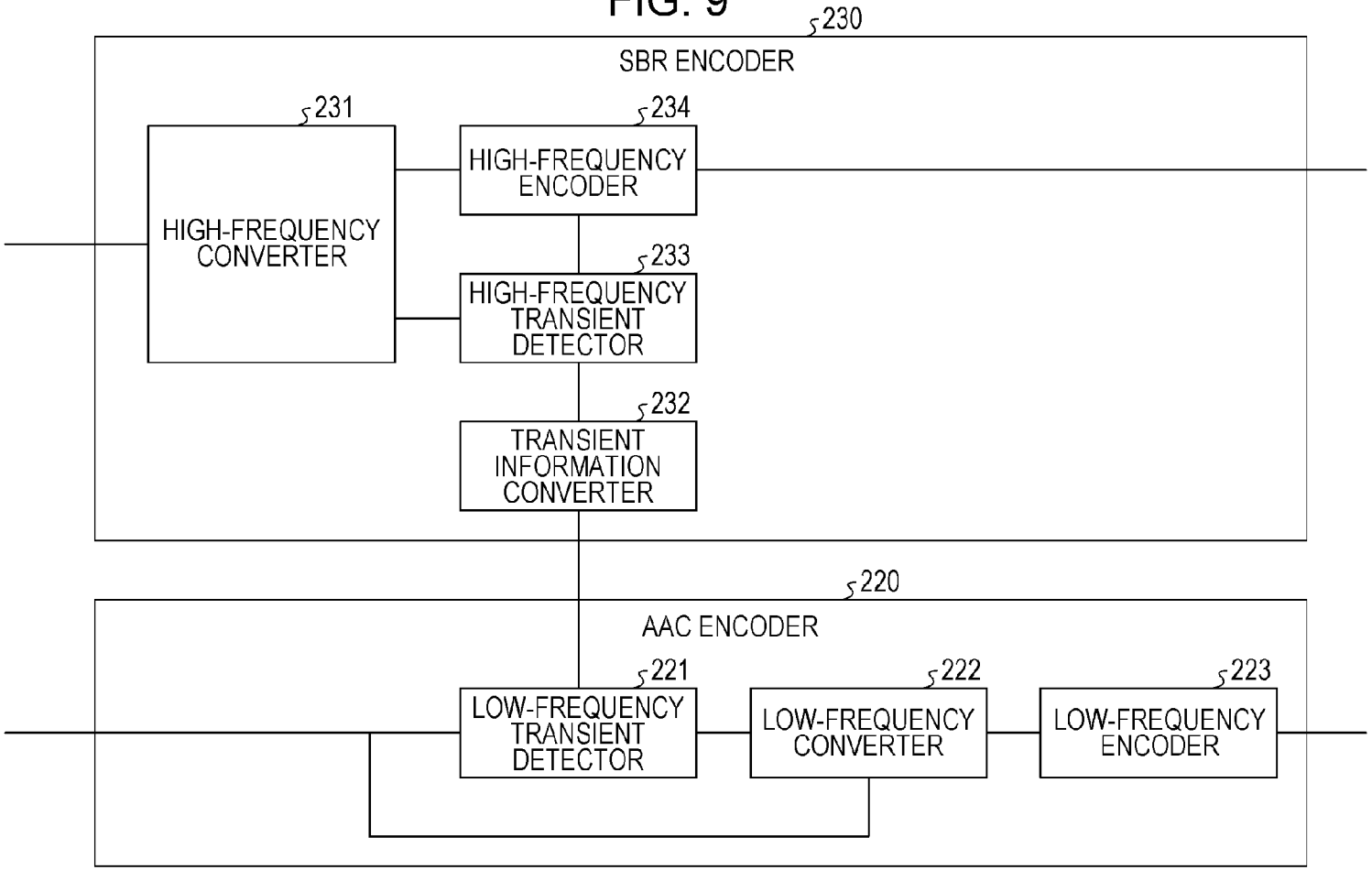
FIG. 9 is a functional block diagram illustrating a configuration of an AAC encoder and an SBR encoder according to the second embodiment.

Now, an exemplary configuration of the AAC encoder 220 and the SBR encoder 230 which are illustrated in FIG. 8 will be described. FIG. 9 is a functional block diagram illustrating a configuration of the AAC encoder 220 and the SBR encoder 230 according to the second embodiment.

As illustrated in FIG. 9, the AAC encoder 220 includes a low-frequency transient detector 221, a low-frequency converter 222, and a low-frequency encoder 223. The SBR encoder 230 includes a high-frequency converter 231, a transient information converter 232, a high-frequency transient detector 233, and a high-frequency encoder 234.

Figure 10:
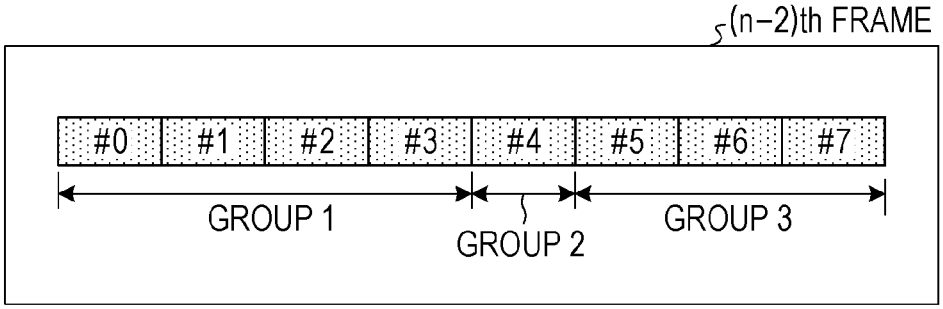
FIG. 10 is a first diagram for explaining a process performed by a low-frequency transient detector according to the second embodiment.
Figure 11:
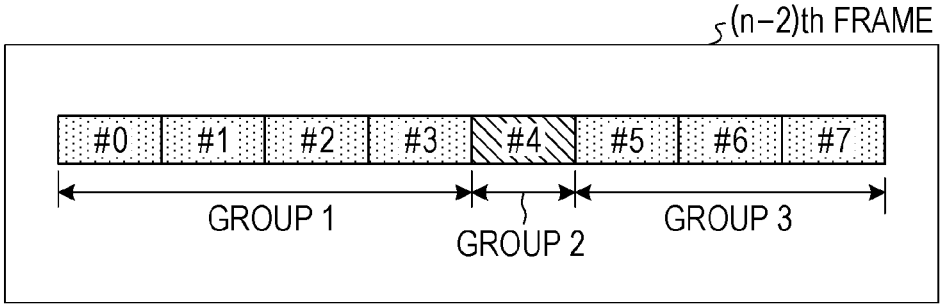
FIG. 11 is a second diagram for explaining a process performed by the low-frequency transient detector according to the second embodiment.

The low-frequency transient detector 221 sequentially obtains the frames of the audio signal obtained through the downsampling, divides each of the frames into eight subframes, and classifies the subframes into an arbitrary number of groups. FIGS. 10 and 11 are diagrams for explaining a process performed by the low-frequency transient detector 221 according to the second embodiment. In the example illustrated in FIG. 10, the low-frequency transient detector 221 classifies subframes #0 to #3 into a group 1, a subframe #4 into a group 2, and subframes #5 to #7 into a group 3.

The low-frequency transient detector 221 analyzes subframes in each of the groups, and detects a subframe including a transient. In the example illustrated in FIG. 11, the low-frequency transient detector 221 has detected a transient in the subframe #4. Accordingly, the low-frequency transient detector 221 has classified the subframes #0 to #3 into the group 1, the subframe #4 into the group 2, and the subframes #5 to #7 into the group 3 so as to perform grouping. The low-frequency transient detector 221 outputs the detection result to the transient information converter 232 as grouping information. In addition, the low-frequency transient detector 221 outputs the detection result to the low-frequency converter 222.

FIG. 12 is a diagram illustrating an exemplary data structure of the grouping information. As illustrated in FIG. 12, the grouping information includes data on the presence/absence of a transient, the position of the transient, and the frame number. For example, when the low-frequency transient detector 221 determines that the subframe #4 of the group 2 in the (n−2)th frame has a transient, the data on the presence/absence of a transient is "presence", the data on the position of the transient is "group 2, #4", and the data on the frame number is "n−2". The grouping information may include information for identifying the way in which subframes have been separated into groups. For example, the grouping information may include information describing that the subframes #0 to #3 are classified into the group 1, the subframe #4 is classified into the group 2, and the subframes #5 to #7 are classified into the group 3.

The low-frequency converter 222 is a processor that performs frequency conversion on the audio signal in accordance with the detection result obtained by the low-frequency transient detector 221. The low-frequency converter 222 outputs the audio signal obtained through the frequency conversion, to the low-frequency encoder 223.

Now, the SBR encoder 230 will be described. The high-frequency converter 231 is a processor that performs frequency conversion on an audio signal. The high-frequency converter 231 outputs the audio signal obtained through the frequency conversion, to the high-frequency transient detector 233 and the high-frequency encoder 234.

Figure 13:
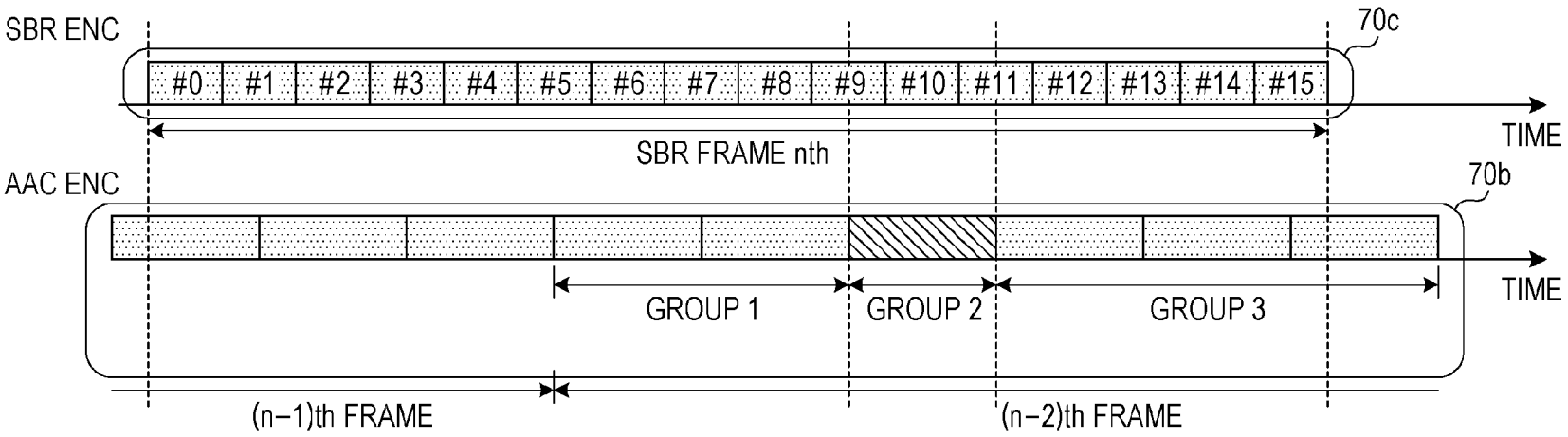
FIG. 13 is a diagram for explaining a process performed by a transient information converter according to the second embodiment.

The transient information converter 232 is a processor that converts the grouping information into the transient information of the high-frequency component. FIG. 13 is a diagram for explaining a process performed by the transient information converter 232 according to the second embodiment. The horizontal axis in FIG. 13 corresponds to the time axis. For example, assume that the grouping information indicates that the group 2 in the (n−2)th frame of the signal 70*b* includes a transient.

The transient information converter 232 determines which subframe in which frame of the signal 70*c* corresponds to the time point obtained by adding a certain time period to the time point of the group 2 in the (n−2)th frame of the signal 70*b*. In the example illustrated in FIG. 13, the transient information converter 232 determines that the subframes #9 to #11 of the nth frame of the signal 70*c* correspond to the group 2. The transient information converter 232 determines that the subframe #9 which is the first subframe among the subframes #9 to #11 includes a transient.

The transient information converter 232 generates transient information of the high-frequency component based on the determination result. FIG. 14 is a diagram illustrating an exemplary data structure of the transient information of the high-frequency component according to the second embodiment. As illustrated in FIG. 14, the transient information of the high-frequency component includes data on the presence/absence of a transient, the frame number, and the subframe number. For example, as described in FIG. 13, when the subframe #9 in the nth frame of the signal 70*c* includes a transient, the data on the presence/absence of a transient is "presence", the data on the frame number is "n", and the data on the subframe number is "#9". The transient information converter 232 outputs the transient information of the high-frequency component to the high-frequency transient detector 233.

The high-frequency transient detector 233 is a processor that outputs the frame number and the subframe number, at which a transient is included, based on the transient information of the high-frequency component to the high-frequency encoder 234.

The high-frequency encoder 234 is a processor that encodes the high-frequency component of the audio signal based on the information obtained from the high-frequency transient detector 233. The high-frequency encoder 234 encodes a frame including no transients with a high frequency resolution. For example, a frequency resolution which is equal to or more than a certain resolution is used.

In contrast, the high-frequency encoder 234 encodes the subframes in the frame including a transient with a high time resolution. For example, a time resolution which is equal to or more than a certain resolution is used. The high-frequency encoder 234 may encode a subframe including no transients with a high frequency resolution. The high-frequency encoder 234 outputs the encoded audio signal to the multiplexer 240.

Figure 15:
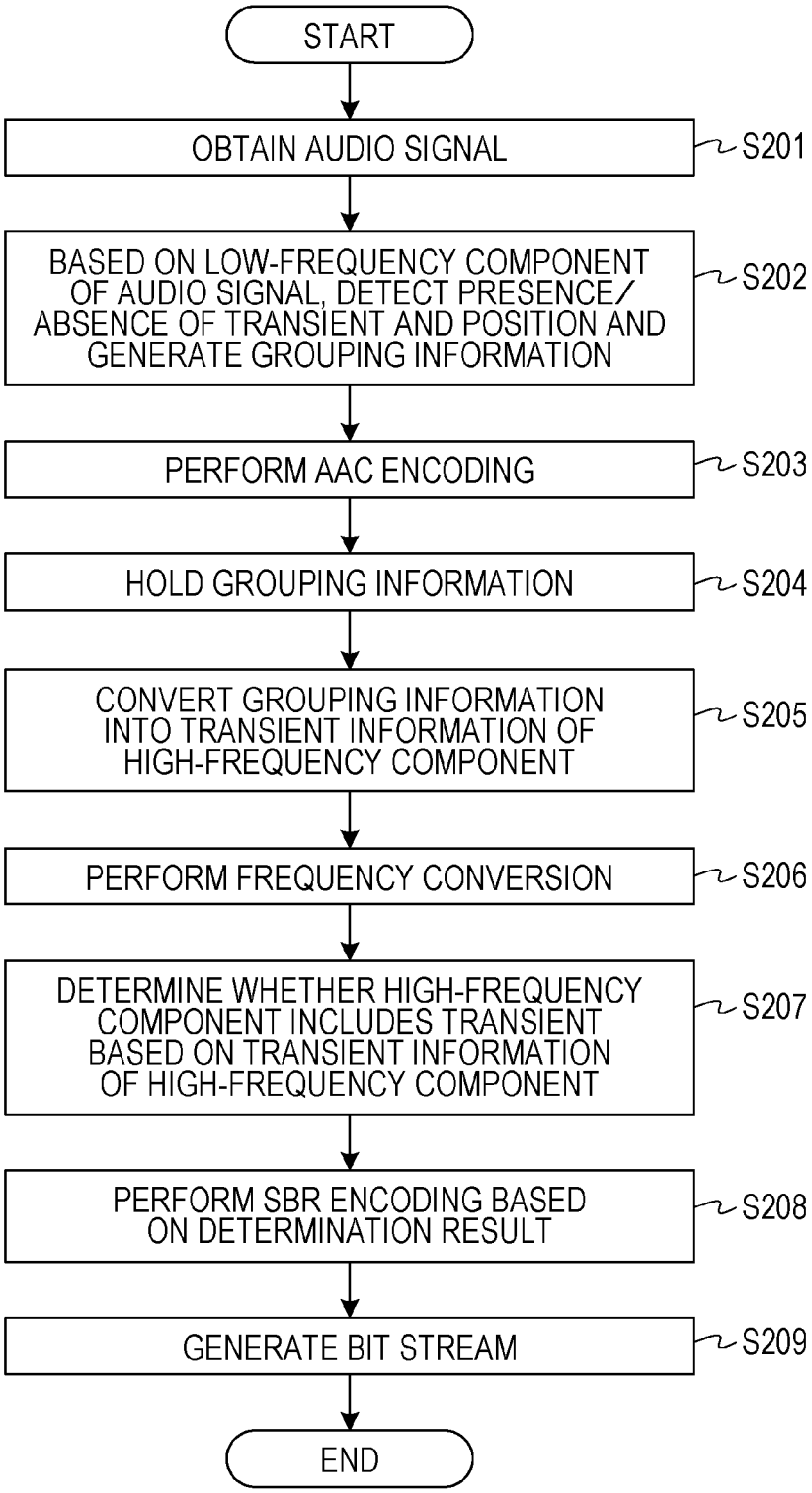
FIG. 15 is a flowchart of a procedure performed by the encoding apparatus according to the second embodiment.

Now, a procedure performed by the encoding apparatus 200 will be described. FIG. 15 is a flowchart of the procedure performed by the encoding apparatus 200 according to the second embodiment. The process illustrated in FIG. 15 is executed when, for example, an audio signal is obtained. As illustrated in FIG. 15, the encoding apparatus 200 obtains an audio signal in operation S201. Based on the low-frequency component of the audio signal, the encoding apparatus 200 detects the presence/absence of a transient and its position, and generates grouping information in operation S202. The encoding apparatus 200 performs AAC encoding in operation S203.

The encoding apparatus 200 holds the grouping information in operation S204, and converts the grouping information into transient information of the high-frequency component in operation S205. The encoding apparatus 200 performs frequency conversion in operation S206. The encoding apparatus 200 determines whether the high-frequency component of the audio signal include a transient based on the transient information of the high-frequency component in operation S207.

The encoding apparatus 200 performs SBR encoding based on the determination result in operation S208, and generates a bit stream in operation S209.

Now, an effect of the encoding apparatus 200 according to the second embodiment will be described. The encoding apparatus 200 converts the grouping information into the transient information of the high-frequency component, and detects a subframe including a transient, without performing an actual transient detection process on the audio signal having the high-frequency component. Accordingly, the SBR encoder 230 does not necessarily detect a transient directly from the audio signal, resulting in reduction in the implementation scale and the processing load.

Third Embodiment

Figure 16:
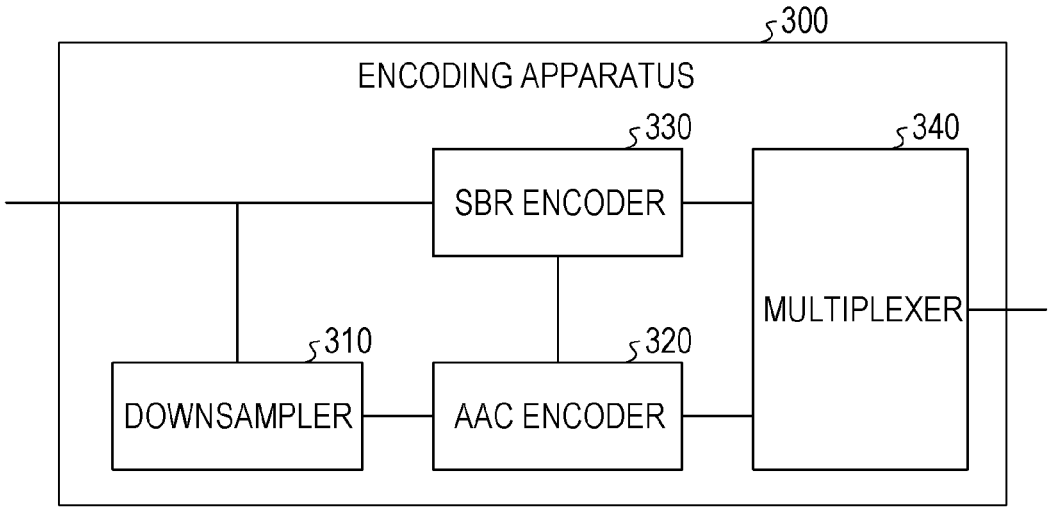
FIG. 16 is a diagram illustrating a configuration of an encoding apparatus according to a third embodiment.

Now, an encoding apparatus according to a third embodiment will be described. FIG. 16 is a diagram illustrating a configuration of the encoding apparatus according to the third embodiment. As illustrated in FIG. 16, an encoding apparatus 300 includes a downsampler 310, an AAC encoder 320, an SBR encoder 330, and a multiplexer 340.

The downsampler 310 is a processor that performs downsampling on an audio signal. The downsampler 310 outputs the audio signal having a low-frequency component obtained through the downsampling, to the AAC encoder 320.

The AAC encoder 320 is a processor that applies AAC to the audio signal having the low-frequency component so as to encode the audio signal having the low-frequency component. The AAC encoder 320 outputs the encoded audio signal having the low-frequency component to the multiplexer 340.

The AAC encoder 320 divides the audio signal having the low-frequency component into multiple subframes. The AAC encoder 320 determines whether or not each of the subframes includes a transient, and outputs the determination result to the SBR encoder 330. In the description below, the determination result as to whether or not each of the subframes has a transient is referred to as transient information of the low-frequency component.

The SBR encoder 330 converts the transient information of the low-frequency component obtained from the AAC encoder 320 into transient information of the high-frequency component, and determines whether or not the audio signal has a transient based on the transient information of the high-frequency component. A process will be described below in which the SBR encoder 330 converts the transient information of the low-frequency component into the transient information of the high-frequency component.

The multiplexer 340 is a processor that multiplexes the encoded audio signal having the low-frequency component and the encoded audio signal having the high-frequency component and that outputs the multiplexed audio signal to an external apparatus.

Figure 17:
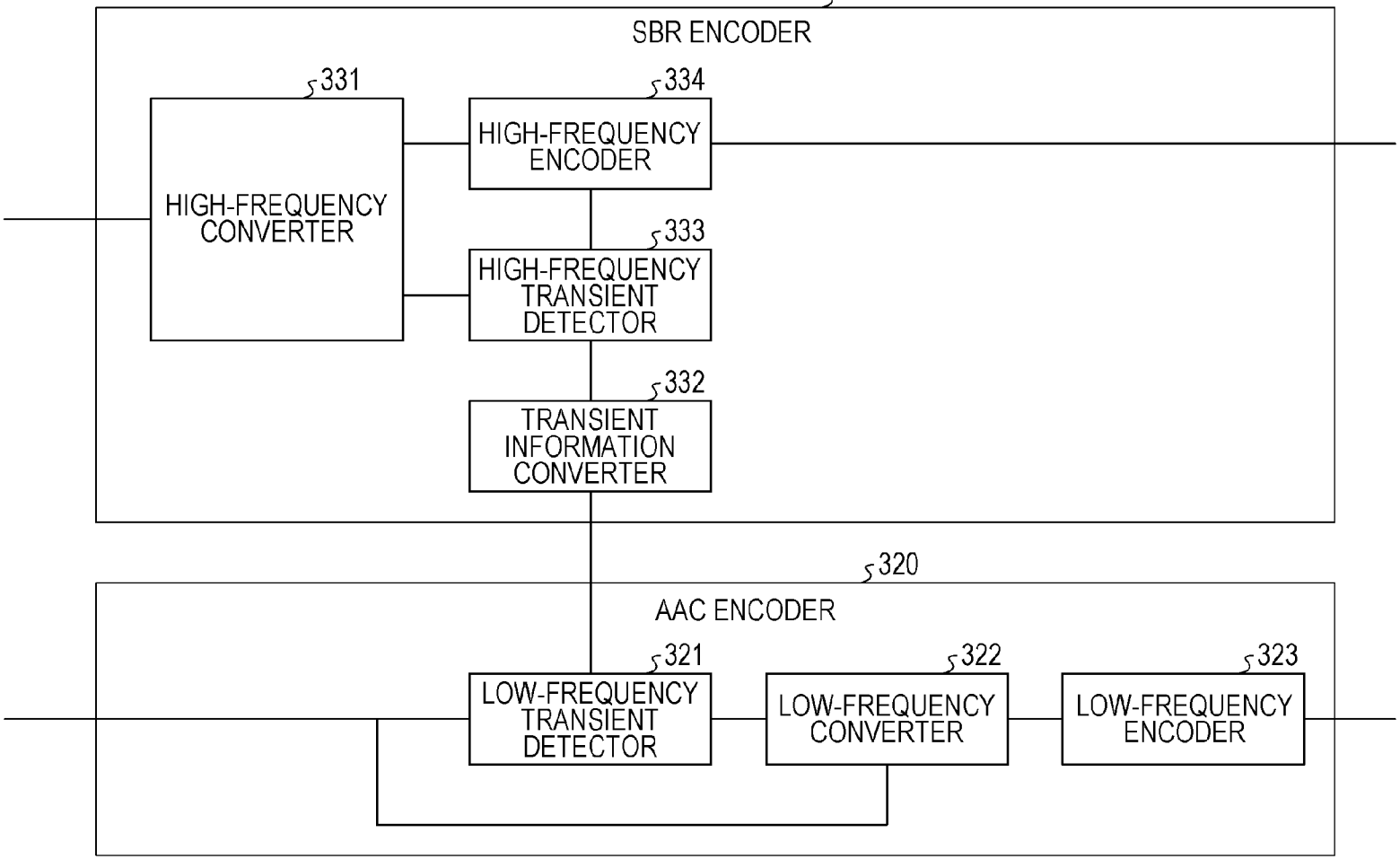
FIG. 17 is a functional block diagram illustrating a configuration of an AAC encoder and an SBR encoder according to the third embodiment.

Now, an exemplary configuration of the AAC encoder 320 and the SBR encoder 330 which are illustrated in FIG. 16 will be described. FIG. 17 is a functional block diagram illustrating a configuration of the AAC encoder 320 and the SBR encoder 330 according to the third embodiment.

As illustrated in FIG. 17, the AAC encoder 320 includes a low-frequency transient detector 321, a low-frequency converter 322, and a low-frequency encoder 323. The SBR encoder 330 includes a high-frequency converter 331, a transient information converter 332, a high-frequency transient detector 333, and a high-frequency encoder 334.

The low-frequency transient detector 321 sequentially obtains the frames of the audio signal obtained through the downsampling, and divides each of the frames into eight subframes. The low-frequency transient detector 321 analyzes each of the subframes and detects a subframe including a transient. The low-frequency transient detector 321 outputs the detection result to the transient information converter 332 as transient information of the low-frequency component. In addition, the low-frequency transient detector 321 outputs the detection result to the low-frequency converter 322.

FIG. 18 is a diagram illustrating an exemplary data structure of transient information of the low-frequency component according to the third embodiment. As illustrated in FIG. 18, the transient information of the low-frequency component includes data on the presence/absence of a transient, the position of the transient, and the frame number. For example, when the subframe #1 in the (n−2)th frame includes a transient, the data on the presence/absence of a transient is "presence", the data on the position of the transient is "#1", and the data on the frame number is "n−2".

The low-frequency converter 322 is a processor that performs frequency conversion on the audio signal in accordance with the detection result obtained by the low-frequency transient detector 321. The low-frequency converter 322 outputs the audio signal obtained through the frequency conversion, to the low-frequency encoder 323.

Now, the SBR encoder 330 will be described. The high-frequency converter 331 is a processor that performs frequency conversion on an audio signal. The high-frequency converter 331 outputs the audio signal obtained through the frequency conversion, to the high-frequency transient detector 333 and the high-frequency encoder 334.

Figure 19:
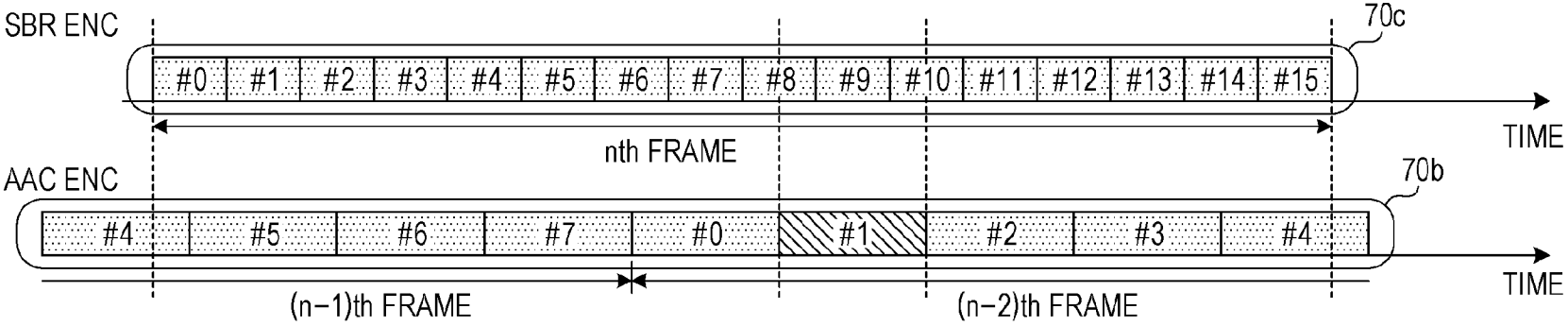
FIG. 19 is a diagram for explaining a process performed by a transient information converter according to the third embodiment.

The transient information converter 332 is a processor that converts the transient information of the low-frequency component into the transient information of the high-frequency component. FIG. 19 is a diagram for explaining a process performed by the transient information converter 332 according to the third embodiment. The horizontal axis in FIG. 19 corresponds to the time axis. For example, assume that the transient information of the low-frequency component indicates that the subframe #1 in the (n−2)th frame of the signal 70*b* includes a transient.

The transient information converter 332 determines which subframe in which frame of the signal 70*c* corresponds to the time point obtained by adding a certain time period to the time point of the subframe #1 in the (n−2)th frame of the signal 70*b*. In the example illustrated in FIG. 19, the transient information converter 332 determines that the subframes #8 to #10 of the signal 70*c* correspond to the subframe #1. The transient information converter 332 determines that the subframe #8 which is the first subframe among the subframes #8 to #10 includes a transient.

The transient information converter 332 generates transient information of the high-frequency component based on the determination result. FIG. 20 is a diagram illustrating an exemplary data structure of the transient information of the high-frequency component according to the third embodiment. As illustrated in FIG. 20, the transient information of the high-frequency component includes data on the presence/absence of a transient, the frame number, and the subframe number. For example, as described in FIG. 19, when the subframe #8 in the nth frame of the signal 70*c* includes a transient, the data on the presence/absence of a transient is "presence", the data on the frame number is "n", and the data on the subframe number is "#8". The transient information converter 332 outputs the transient information of the high-frequency component to the high-frequency transient detector 333.

The high-frequency transient detector 333 is a processor that outputs the frame number and the subframe number, at which a transient is included, based on the transient information of the high-frequency component to the high-frequency encoder 334.

The high-frequency encoder 334 is a processor that encodes the high-frequency component of the audio signal based on the information obtained from the high-frequency transient detector 333. The high-frequency encoder 334 encodes a frame including no transients with a high frequency resolution. For example, a frequency resolution which is equal to or more than a certain resolution is used.

In contrast, the high-frequency encoder 334 encodes the subframes in the frame including a transient with a high time resolution. For example, a time resolution which is equal to or more than a certain resolution is used. The high-frequency encoder 334 may encode a subframe including no transients with a high frequency resolution. The high-frequency encoder 334 outputs the encoded audio signal to the multiplexer 340.

Figure 21:
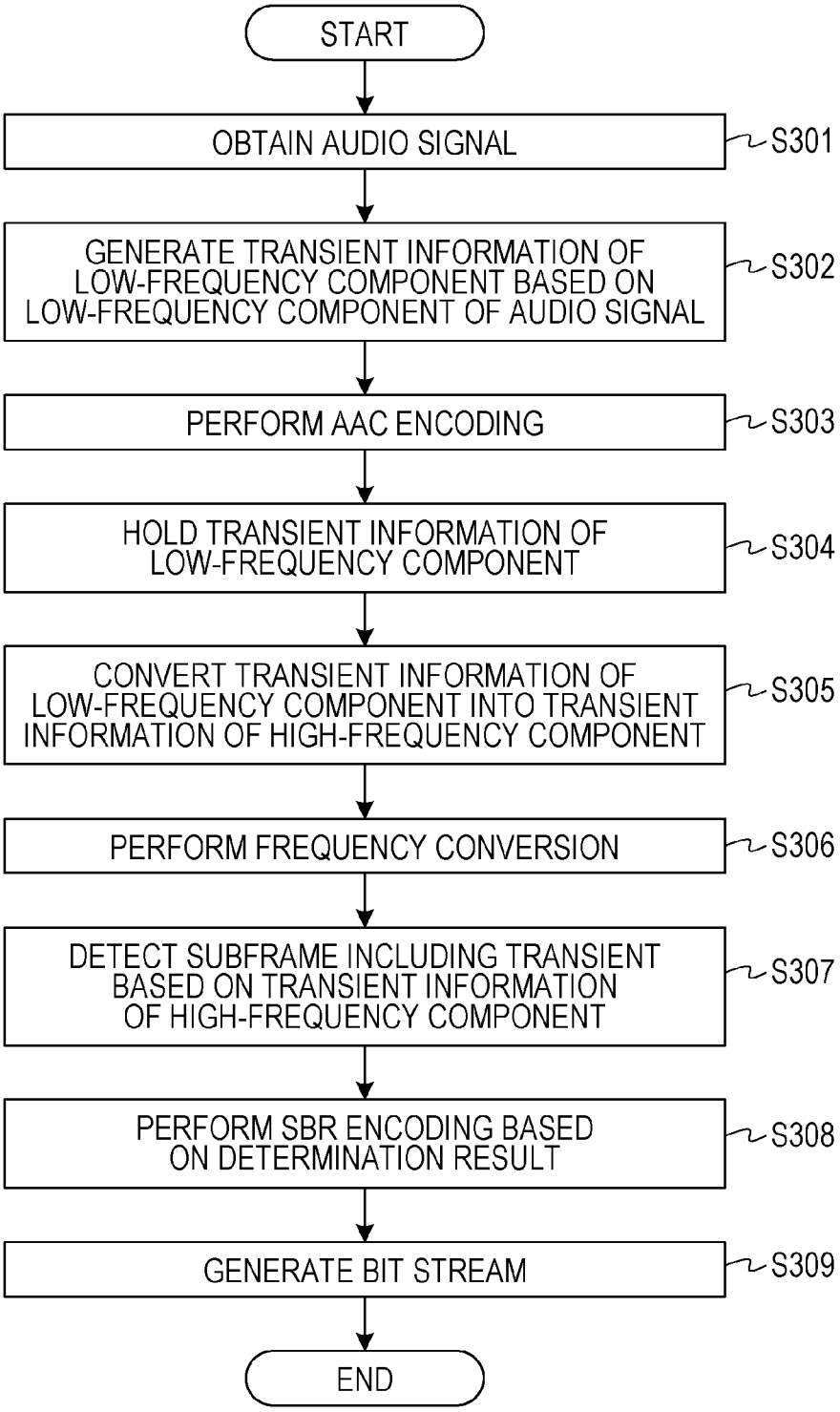
FIG. 21 is a flowchart of a procedure performed by the encoding apparatus according to the third embodiment.

Now, a procedure performed by the encoding apparatus 300 will be described. FIG. 21 is a flowchart of the procedure performed by the encoding apparatus 300 according to the third embodiment. For example, The process illustrated in FIG. 21 is executed when an audio signal is obtained. As illustrated in FIG. 21, the encoding apparatus 300 obtains an audio signal in operation S301. The encoding apparatus 300 generates transient information of the low-frequency component based on the low-frequency component of the audio signal in operation S302. The encoding apparatus 300 performs AAC encoding in operation S303.

The encoding apparatus 300 holds the transient information of the low-frequency component in operation S304, and converts the transient information of the low-frequency component into transient information of the high-frequency component in operation S305. The encoding apparatus 300 performs frequency conversion in operation S306. The encoding apparatus 300 detects a subframe including a transient based on the transient information of the high-frequency component in operation S307.

The encoding apparatus 300 performs SBR encoding based on the detection result in operation S308, and generates a bit stream in operation S309.

Now, an effect of the encoding apparatus 300 according to the third embodiment will be described. The encoding apparatus 300 converts the transient information of the low-frequency component into the transient information of the high-frequency component, and detects a subframe including a transient, without performing an actual transient detection process on the audio signal having the high-frequency component. Accordingly, the SBR encoder 330 does not necessarily detect a transient directly from the audio signal, resulting in reduction in the implementation scale and the processing load.

Now, an alternative process performed by the encoding apparatus 300 will be described. In the example illustrated in FIG. 19, it is determined that a transient is included in the subframe #8 which is the first subframe among the subframes #8 to #10. However, the determination is not limited to this. For example, the transient information converter 332 may output information describing the frame number n and the subframes #8 to #10 of the signal 70*c* to the high-frequency transient detector 333 as transient information of the high-frequency component.

In this case, the high-frequency transient detector 333 performs detection of a transient on the subframes #8 to #10 of the nth frame, and outputs the detection result to the high-frequency encoder 334. Thus, the encoding apparatus 300 determines whether or not a transient is included, only for subframes including a transient, resulting in reduction in the processing load.

Figure 22:
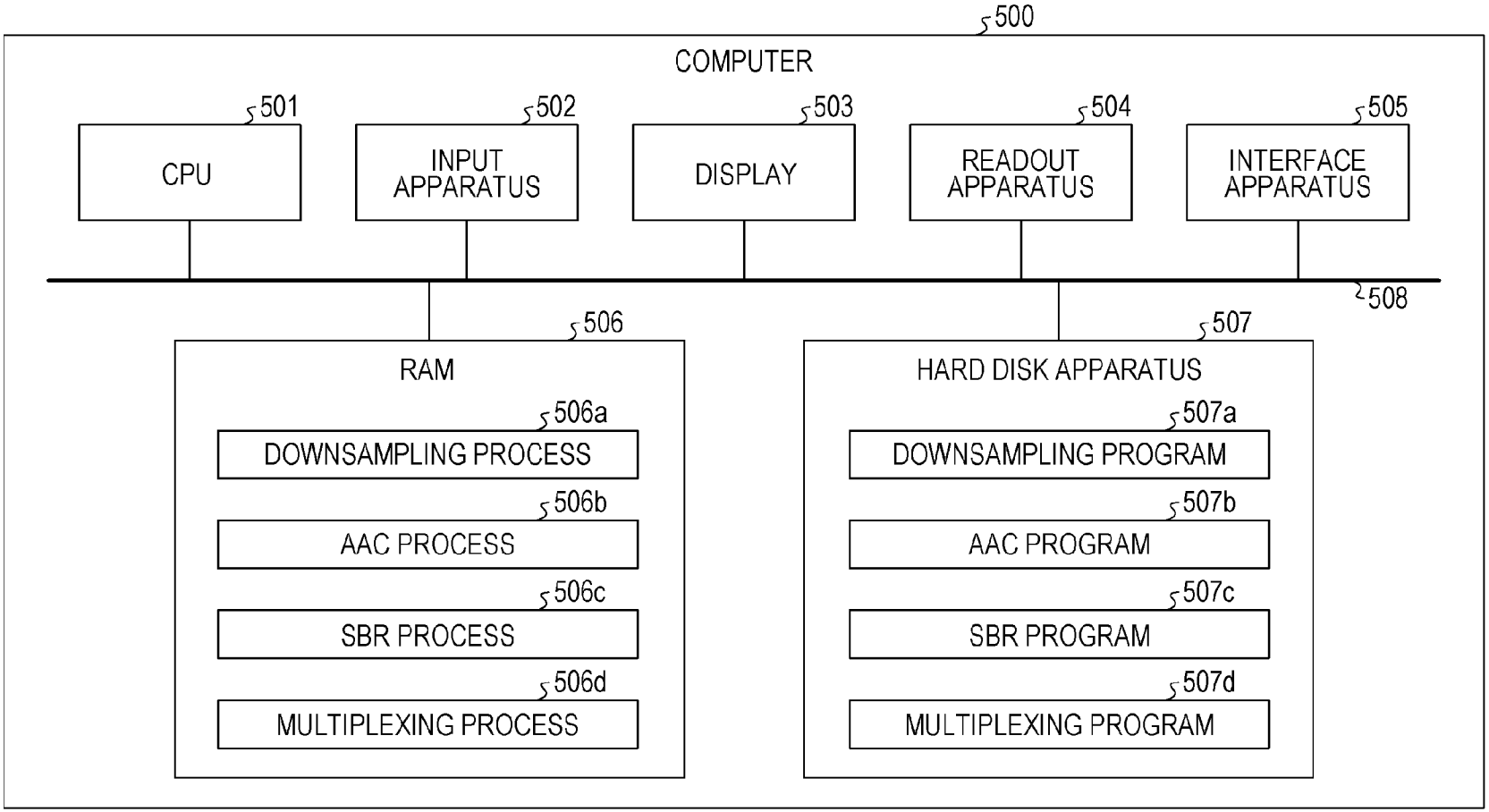
FIG. 22 is a diagram illustrating an exemplary computer which executes an encoding program.
Figure 23:
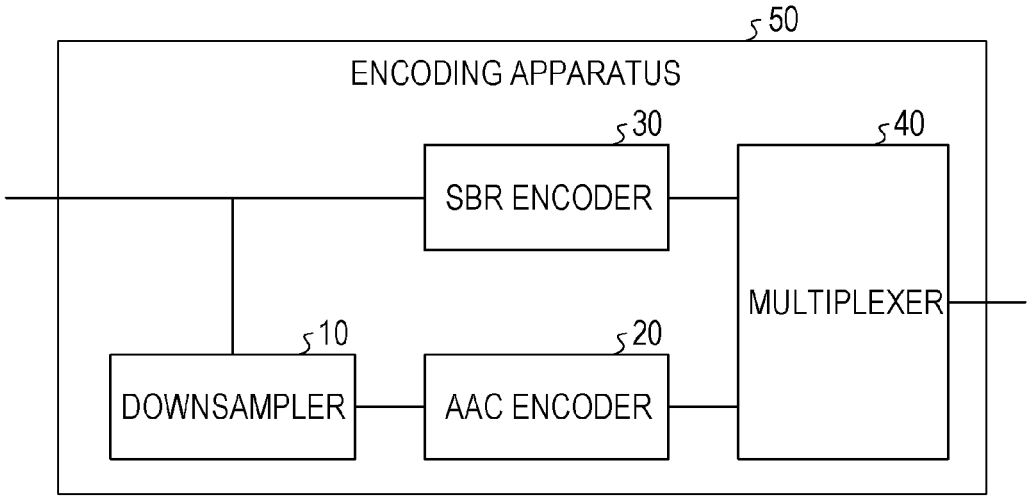
FIG. 23 RELATED ART
FIG. 23 is a diagram illustrating a configuration of an encoding apparatus of the related art.
Figure 24:
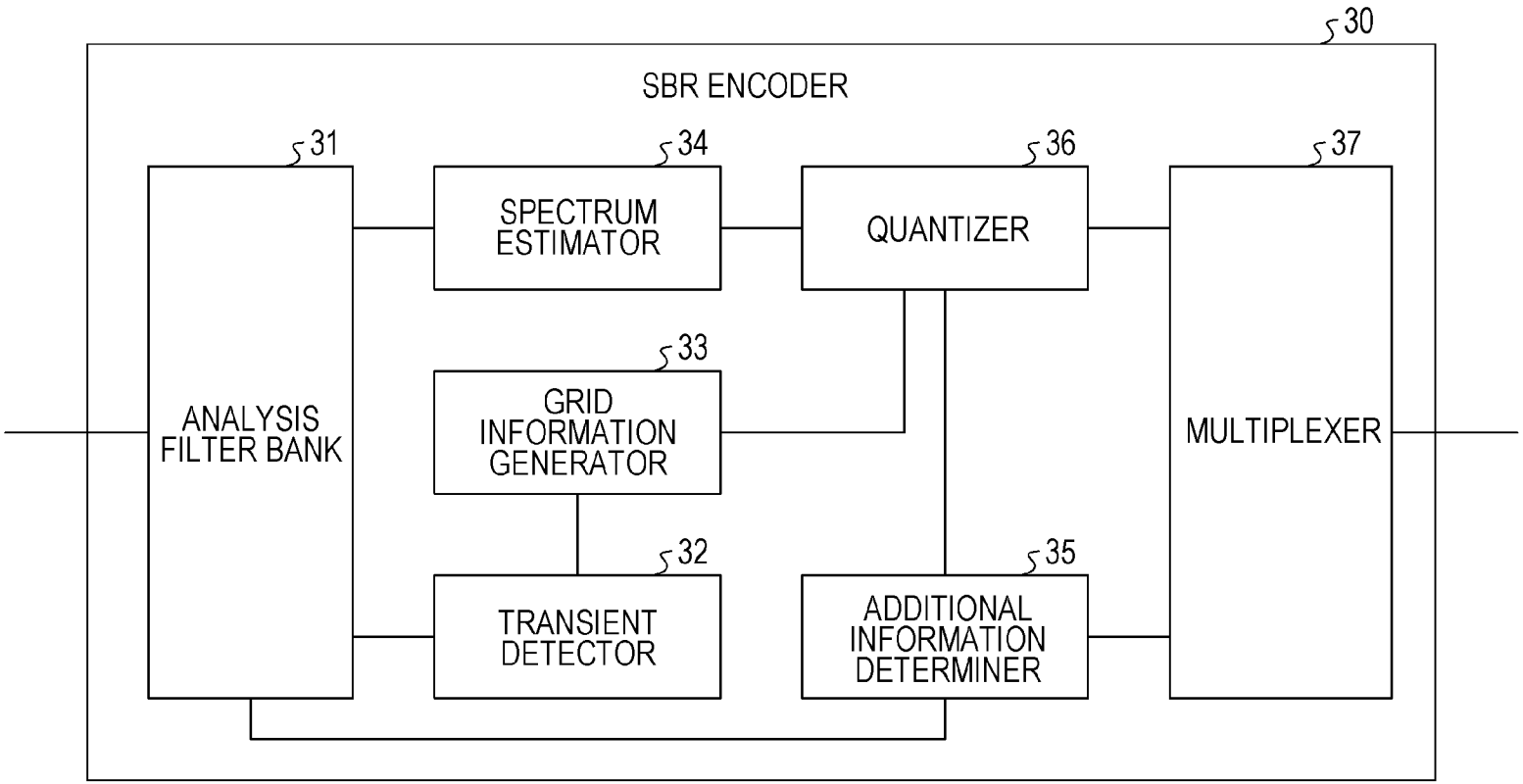
FIG. 24 RELATED ART
FIG. 24 is a diagram illustrating a configuration of an SBR encoder.
Figure 25:
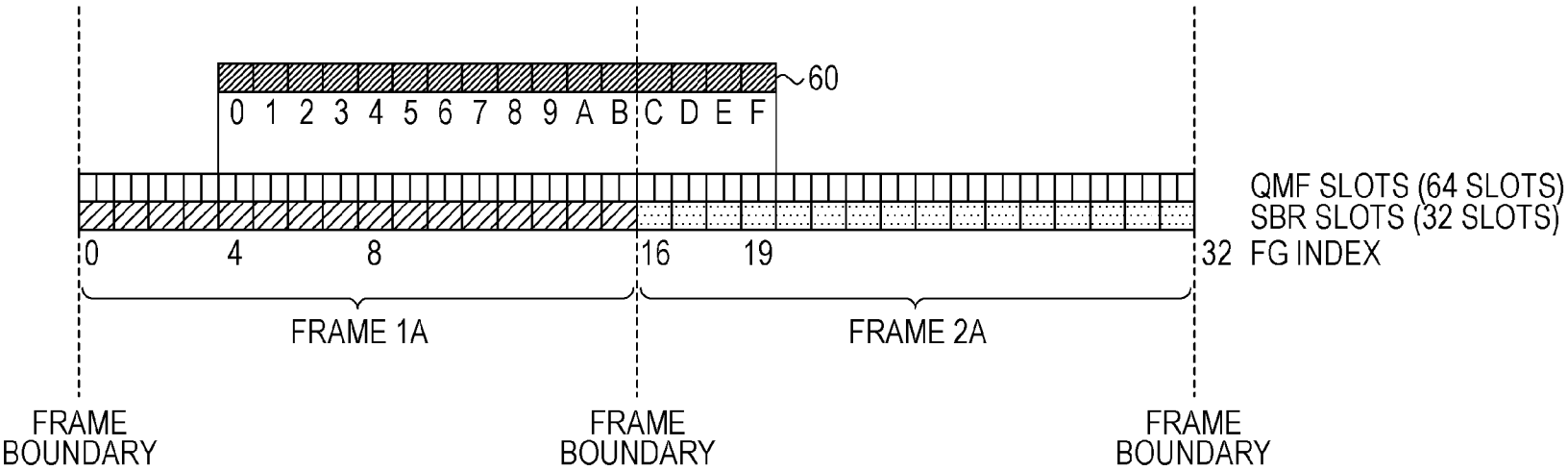
FIG. 25 RELATED ART
FIG. 25 is a diagram for explaining a process performed by a transient detector.

Now, an exemplary computer will be described which executes encoding programs for achieving functions similar to the encoding apparatuses described in the first to third embodiments. FIG. 22 is a diagram illustrating the exemplary computer which executes the encoding programs.

As illustrated in FIG. 22, a computer 500 includes a central processing unit (CPU) 501 which executes various kinds of arithmetic processing, an input apparatus 502 which receives data input from a user, and a display 503. The computer 500 also includes a readout apparatus 504 which reads out programs and the like from storage media, and an interface apparatus 505 which receives/sends data from/to other computers via a network. The computer 500 further includes a random-access memory (RAM) 506 which stores various kinds of information temporarily, and a hard disk apparatus 507. The CPU 501, the input apparatus 502, the display 503, the readout apparatus 504, the interface apparatus 505, the RAM 506, and the hard disk apparatus 507 are connected to a bus 508.

The hard disk apparatus 507 includes, for example, a downsampling program 507*a*, an AAC program 507*b*, an SBR program 507*c*, and a multiplexing program 507*d*. The CPU 501 reads out the downsampling program 507*a*, the AAC program 507*b*, the SBR program 507*c*, and the multiplexing program 507*d*, and develops them in the RAM 506.

The downsampling program 507*a* functions as a downsampling process 506*a*. The AAC program 507*b* functions as an AAC process 506*b*. The SBR program 507*c* functions as an SBR process 506*c*. The multiplexing program 507*d* functions as a multiplexing process 506*d*.

For example, the downsampling process 506*a* corresponds to the downsamplers 110, 210, and 310. The AAC process 506*b* corresponds to the AAC encoders 120, 220, and 320. The SBR process 506*c* corresponds to the SBR encoders 130, 230, and 330. The multiplexing process 506*d* corresponds to the multiplexers 140, 240, and 340.

The downsampling program 507*a*, the AAC program 507*b*, the SBR program 507*c*, and the multiplexing program 507*d* are not necessarily stored in advance in the hard disk apparatus 507. For example, these programs are stored in a "portable physical medium", such as a flexible disk (FD), a compact disk-read-only memory (CD-ROM), a digital versatile disk (DVD), a magneto-optical disk, or an integrated circuit (IC) card, which is inserted into the computer 500. Then, the computer 500 may read out the downsampling program 507*a*, the AAC program 507*b*, the SBR program 507*c*, and the multiplexing program 507*d* from the inserted medium and execute them.

Each of the downsampler 110, the AAC encoder 120, the SBR encoder 130, and the multiplexer 140 illustrated in FIG. 1 corresponds to, for example, an integrated device, such as an application specific integrated circuit (ASIC) or a field programmable gate array (FPGA). In addition, each of the downsampler 110, the AAC encoder 120, the SBR encoder 130, and the multiplexer 140 corresponds to, for example, an electronic circuit, such as a CPU or a micro processing unit (MPU). Furthermore, each of the downsampler 110, the AAC encoder 120, the SBR encoder 130, and the multiplexer 140 may have a storage device. Similar descriptions are made for the downsampler 210, the AAC encoder 220, the SBR encoder 230, and the multiplexer 240, which are illustrated in FIG. 8, and the downsampler 310, the AAC encoder 320, the SBR encoder 330, and the multiplexer 340, which are illustrated in FIG. 16.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An encoding method executed by a processor included in a computer, the method comprising:

specifying a position of a signal having an abrupt amplitude change included in a high-frequency component of an audio signal, corresponding to a position of a signal having an abrupt amplitude change included in a low-frequency component of the audio signal;

detecting the signal having the abrupt amplitude change included in the high-frequency component of the audio signal, based on the high-frequency component of the audio signal and the specified position; and encoding the high-frequency component of the audio signal based on the detected signal, wherein the specifying includes:

extracting a first frame including a signal having an abrupt amplitude change from among a plurality of frames corresponding to a low-frequency component of the audio signal, and specifying a second frame including a signal having an abrupt amplitude change from among a plurality of frames corresponding to a high-frequency component of the audio signal, by adding a predetermined time to a time of the first frame, and wherein the detecting includes:

dividing the specified second frame into a plurality of subframes, and detecting a subframe having an abrupt amplitude change from among the plurality of subframes.

2. The encoding method according to claim 1,
wherein the specifying of the position includes:
dividing the first frame into a plurality of subframes; and
extracting a first subframe having an abrupt amplitude change from among the plurality of subframes, and
the specifying of the second frame includes specifying the second frame by adding the predetermined time to the time of the first subframe.

3. The encoding method according to claim 2,
wherein the specifying of the second frame includes:
generating a plurality of groups by grouping the plurality of subframes in the first frame based on a position of the first subframe, and
specifying the second frame by adding the predetermined time to a time of a group to which the first subframe belongs among the plurality of groups.

4. The encoding method according to claim 2,
wherein the detecting includes:
specifying a plurality of second subframes corresponding to the group to which the first subframe belongs, from among the plurality of subframes in the second frame, and
selecting an earliest subframe as the subframe having an abrupt amplitude change from among the plurality of second subframes.

5. The encoding method according to claim 2,
wherein the detecting includes:
specifying a plurality of third subframes corresponding to the first subframe, from among the plurality of subframes in the second frame, and
selecting an earliest subframe as the subframe having an abrupt amplitude change from among the plurality of third subframes.

6. The encoding method according to claim 2,
wherein the specifying of the second frame includes:
generating transient information that includes a frame number of the first frame and a subframe number of the first subframe, and
wherein the specifying of the second frame includes specifying the second frame by using the subframe number included in the transient information.

7. An encoding apparatus comprising:
a transient information converter configured to specify a position of a signal having an abrupt amplitude change included in a high-frequency component of an audio signal, corresponding to a position of a signal having an abrupt amplitude change included in a low-frequency component of the audio signal;
a high-frequency transient detector configured to detect the signal having the abrupt amplitude change included in the high-frequency component of the audio signal, based on the high-frequency component of the audio signal and the specified position; and
a high-frequency encoder configured to encode the high-frequency component of the audio signal based on the detected signal,
wherein the transient information converter is configured to extract a first frame including a signal having an abrupt amplitude change from among a plurality of frames corresponding to a low-frequency component of the audio signal, and
wherein the high-frequency transient detector is configured to:
specify a second frame including a signal having an abrupt amplitude change from among a plurality of frames corresponding to a high-frequency component of the audio signal, by adding a predetermined time to a time of the first frame,
divide the specified second frame into a plurality of subframes, and
detect a subframe having an abrupt amplitude change from among the plurality of subframes.

8. The encoding apparatus according to claim 7,
wherein the transient information converter is configured to:
divide the first frame into a plurality of subframes,
extract a first subframe having an abrupt amplitude change from among the plurality of subframes in the first frame, and
specify the second frame by adding the predetermined time to a time of the first subframe.

9. The encoding apparatus according to claim 8,
wherein the transient information converter is configured to:
generate a plurality of groups by grouping the plurality of subframes in the first frame based on a position of the first subframe, and
specify the second frame by adding the predetermined time to a time of a group to which the first subframe belongs among the plurality of groups.

10. The encoding apparatus according to claim 8,
wherein the high-frequency transient detector is configured to:
specify a plurality of second subframes corresponding to the group to which the first subframe belongs, from among the plurality of subframes in the second frame, and
select an earliest subframe as the subframe having an abrupt amplitude change from among the plurality of second subframes.

11. The encoding apparatus according to claim 8,
wherein the high-frequency transient detector is configured to:
specify a plurality of third subframes corresponding to the first subframe, from among the plurality of subframes in the second frame, and
select an earliest subframe as the subframe having an abrupt amplitude change from among the plurality of third subframes.

12. The encoding apparatus according to claim 8, wherein
the transient information converter is configured to generate transient information that includes a frame number of the first frame and a subframe number of the first subframe, and
the specifying of the second frame includes specifying the second frame by using the subframe number included in the transient information.

13. A non-transitory computer-readable recording medium storing a program that causes a computer to execute a process, the process comprising:
specifying a position of a signal having an abrupt amplitude change included in a high-frequency component of an audio signal, corresponding to a position of a signal having an abrupt amplitude change included in a low-frequency component of the audio signal;
detecting the signal having the abrupt amplitude change included in the high-frequency component of the audio signal, based on the high-frequency component of the audio signal and the specified position; and
encoding the high-frequency component of the audio signal based on the detected signal, wherein the specifying includes:

extracting a first frame including a signal having an abrupt amplitude change from among a plurality of frames corresponding to a low-frequency component of the audio signal, and specifying a second frame including a signal having an abrupt amplitude change from among a plurality of frames corresponding to a high-frequency component of the audio signal, by adding a predetermined time to a time of the first frame, and wherein the detecting includes:

dividing the specified second frame into a plurality of subframes, and detecting a subframe having an abrupt amplitude change from among the plurality of subframes.

14. The non-transitory computer-readable recording medium according to claim 13, wherein the specifying of the position includes:

dividing the first frame into a plurality of subframes, extracting a first subframe having an abrupt amplitude change from among the plurality of subframes in the first frame, and specifying the second frame by adding the predetermined time to a time of the first subframe.

15. The non-transitory computer-readable recording medium according to claim 14, wherein the specifying of the second frame includes:

generating a plurality of groups by grouping the plurality of subframes in the first frame based on a position of the first subframe, and specifying the second frame by adding the predetermined time to a time of a group to which the first subframe belongs among the plurality of groups.

16. The non-transitory computer-readable recording medium according to claim 14, wherein the detecting includes:

specifying a plurality of second subframes corresponding to the group to which the first subframe belongs, from among the plurality of subframes in the second frame, and selecting an earliest subframe as the subframe having an abrupt amplitude change from among the plurality of second subframes.

17. The non-transitory computer-readable recording medium according to claim 14, wherein the detecting includes:

specifying a plurality of third subframes corresponding to the first subframe, from among the plurality of subframes in the second frame, and selecting an earliest subframe as the subframe having an abrupt amplitude change from among the plurality of third subframes.

18. The non-transitory computer-readable recording medium according to claim 14, wherein the specifying of the second frame includes generating transient information that includes a frame number of the first frame and a subframe number of the first subframe, and the specifying of the second frame includes specifying the second frame by using the subframe number included in the transient information.

* * * * *